US005854541A

United States Patent [19]

Chou

[11] Patent Number: 5,854,541

[45] Date of Patent: Dec. 29, 1998

[54] FLICKER LIGHT STRING SUITABLE FOR UNLIMITED SERIES-CONNECTION

[76] Inventor: Tsung-Ming Chou, 1 Lane 328, Chung Hsin Road, Sec. 3, Chu-Tung Haian, Hsin Chu Hsien, Taiwan, 310

[21] Appl. No.: 820,630

[22] Filed: Mar. 19, 1997

[51] Int. Cl.[6] ..... H05B 37/00

[52] U.S. Cl. ..... 315/185 R; 315/185 S; 362/806

[58] Field of Search ..... 315/185 R, 185 S, 315/178, 201, 195; 362/252, 227, 800, 806, 807, 808, 809, 810, 811, 812

[56] References Cited

U.S. PATENT DOCUMENTS 3,789,211 1/1974 Kramer ..... 315/195
4,713,586 12/1987 Chiang ..... 315/200 A
4,769,579 9/1988 Jou ..... 315/201
4,890,000 12/1989 Chou ..... 307/36
5,008,595 4/1991 Kazar ..... 315/178

*Primary Examiner*—Don Wong
*Assistant Examiner*—David H. Vu
*Attorney, Agent, or Firm*—Dougherty & Troxell

[57] ABSTRACT

A flicker light string suitable for unlimited series-connection, each light string including a driver and a plurality of series-connected lamps. The driver has an input end connected to an independent external power supply and a trigger circuit. The trigger circuit has an output end connected to the series-connected lamps and a trigger end reserved for connection to an external cord for acquiring an oscillatory signal to control the continuity and interruption of the trigger circuit, so that the light string can flicker with the oscillatory signal. Multiple units of the flicker light string can be serially connected to form an unlimited extending flicker light string, and all the connected light strings can flicker synchronously without the risk of being overloaded or overheated.

4 Claims, 5 Drawing Sheets

FLICKER LIGHT STRING SUITABLE FOR UNLIMITED SERIES-CONNECTION

BACKGROUND OF THE INVENTION

The present invention relates to an improved flicker light string, and more particularly to a flicker light string which can be extended in an unlimited length by serial connection with other similar light strings, so that all the connected light strings can flicker synchronously without the risk of being overloaded and overheated.

Conventional flicker light strings are frequently used as a decoration in festivities, commercial advertisements, and on many special occasions. Such conventional light strings each can have only limited numbers of lamps because of the limited amperage of wires for the light string. To extend the length of the light string by connecting too many lamps to the wire of the light string shall cause the wire to be overloaded and overheated and even cause the lamp's to be burned out. To solve this problem, it is a common practice to use multiple separate light strings to complete the decoration. The drawback of this solution is that not all the light strings can flicker synchronously. To overcome this problem, some of the manufacturers/customers ignore the wire load and arbitrarily extend the light strings to use the same at the risk of public safety while others use larger wires and increase the output of controllers for the light strings. The larger wires and high output controllers significantly increase the manufacturing cost of the light strings. For example, the price for an electronic device of 500 A is much higher than that for an device of 5 A. And, even with these dangerous and costly means, the light strings still have limitation in their length and cannot be unlimitedly extended. In addition, it is difficult and inconvenient in the repair, maintenance, and installation of such extended light strings.

The inventor has developed a flicker light string suitable for series-connection to eliminate the drawbacks existed in the conventional flicker light strings.

SUMMARY OF THE INVENTION

A primary object of the present invention is to provide a flicker light string in which multiple units can be serially connected to unlimitedly extend the string length without the risk of overload.

Another object of the present invention is to provide a flicker light string suitable for series-connection wherein an output end of the driver of the light string can be changed as desired to adapt to either a two-wire or a three-wire light string.

To achieve the above objects, the flicker light string according to the present invention includes a plurality of series-connected lamps and a driver. The flicker light string so formed has an independent external power supply connected to an input end of the controller. The driver has a trigger circuit inside it. An output end of the circuit is connected to the series-connected lamps and a trigger end thereof is reserved for acquiring outcoming oscillatory signals for controlling the continuity and interruption of the trigger circuit, whereby the light string can flicker with the signals. By this way, multiple flicker light strings of the present invention can be serially connected as required without limitation in the length of the connected light strings. All the serially connected flicker light strings can flicker synchronously without the risk of overloading and overheating.

BRIEF DESCRIPTION OF THE DRAWINGS

The detailed structure of and the technical means adopted by the present invention, and the features, functions and operation thereof can be best understood by referring to the following detailed description of the preferred embodiment and the accompanying drawings, wherein.

DETAILED DESCRIPTION OF THE PREFERRED EMOB0DIMENT

Figure 1A:
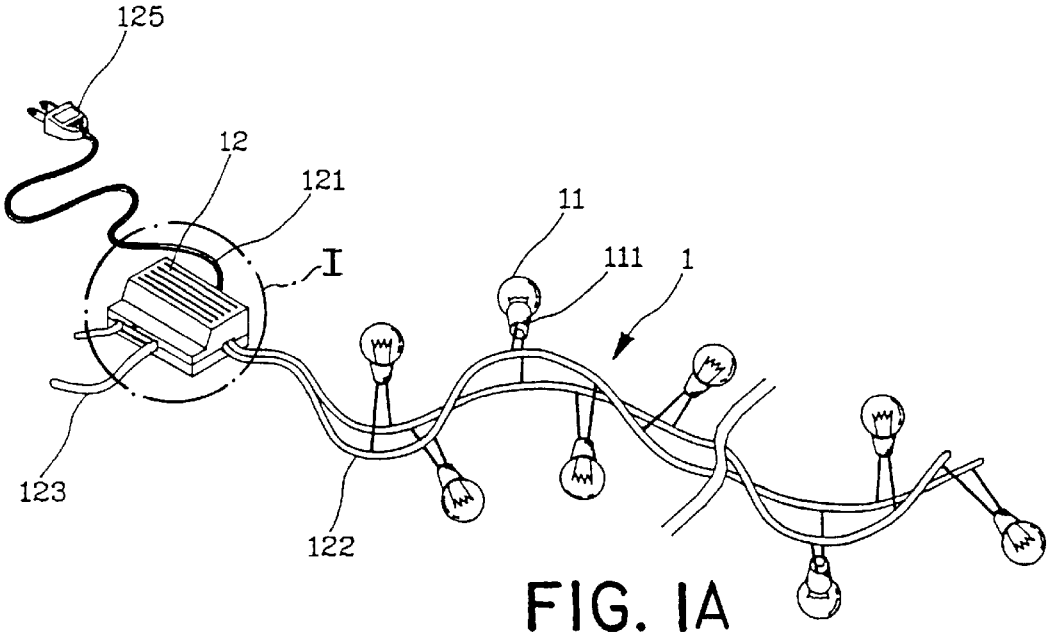
FIG. 1A is a perspective view showing the light string of the present invention.
Figure 1B:
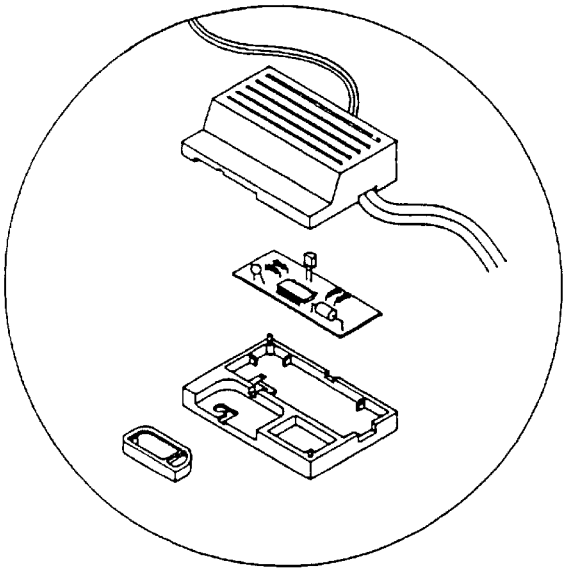
"FIG. 1B is an exploded perspective view of area I in FIG. 1A"
Figure 2:
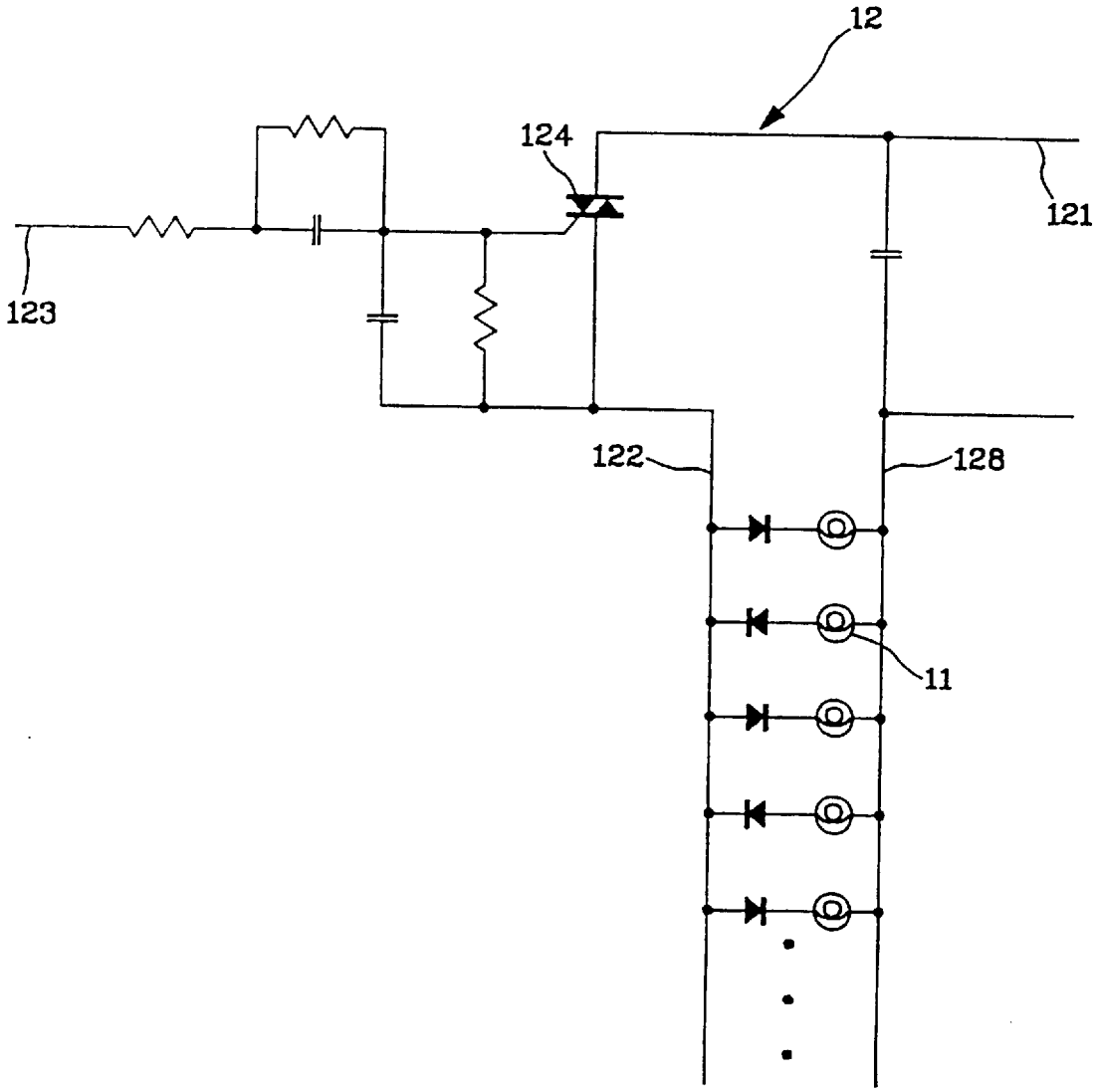
FIG. 2 is a circuit diagram of one unit of the present invention.

Please refer to FIGS. 1A, 1B and 2. The present invention relates to a flicker light string 1 including a plurality of series-connected lamps 11 and a driver 12.

The lamp 11 each is fixedly connected to a lampholder 111 having a diode. The lampholder 111 is then connected to two wires.

The driver 12 has a trigger circuit inside it. The trigger circuit is formed with a single TRIAC transistor 124 and other resistances and capacitances. A power input end 121 of the sub-driver is provided with a plug 125 for connecting with an external power source. An output end 122 of the driver 12 is connected to one end of the series-connected lamps 11 while the other end of the lamps 11 are connected to a common ground end 128. A trigger end 123 of the circuit is reserved for connection to an external wire for acquiring an oscillatory signal to control the continuity and interruption of the trigger circuit. The trigger- end 123 is reserved by providing a copper piercing means on the driver 12, so that the driver 12 can be directly assembled to a conductor containing the oscillatory signal.

With the above arrangements, each flicker light string of the present invention has an independent external power supply and a trigger end 123 to acquire an oscillatory signal, causing the lamps 11 on the string to flash synchronously with the oscillating signal.

Figure 3:
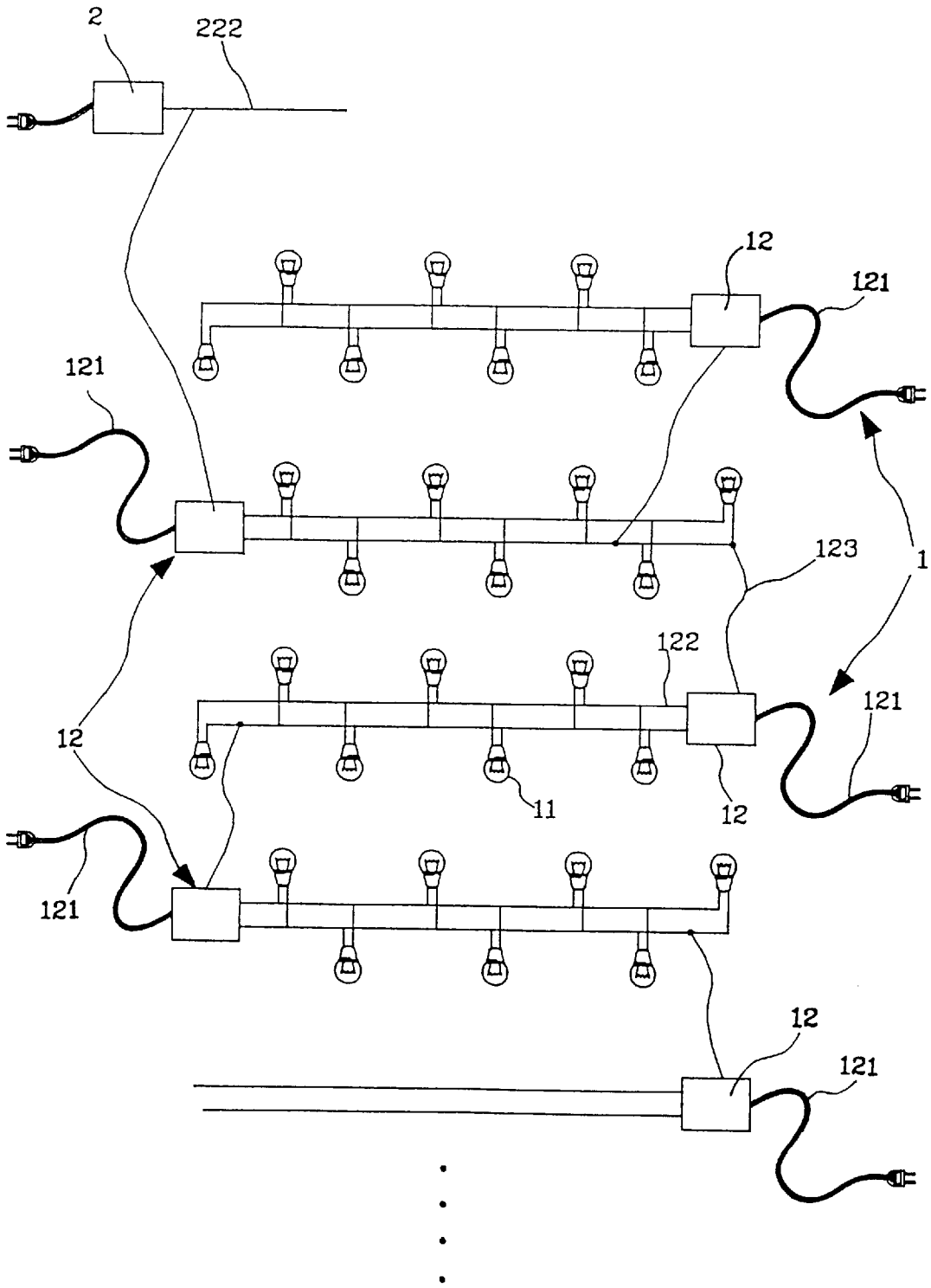
FIG. 3 shows the manner in which multiple units of the present invention are serially connected without limitation in a total length of the connected strings.
Figure 4:
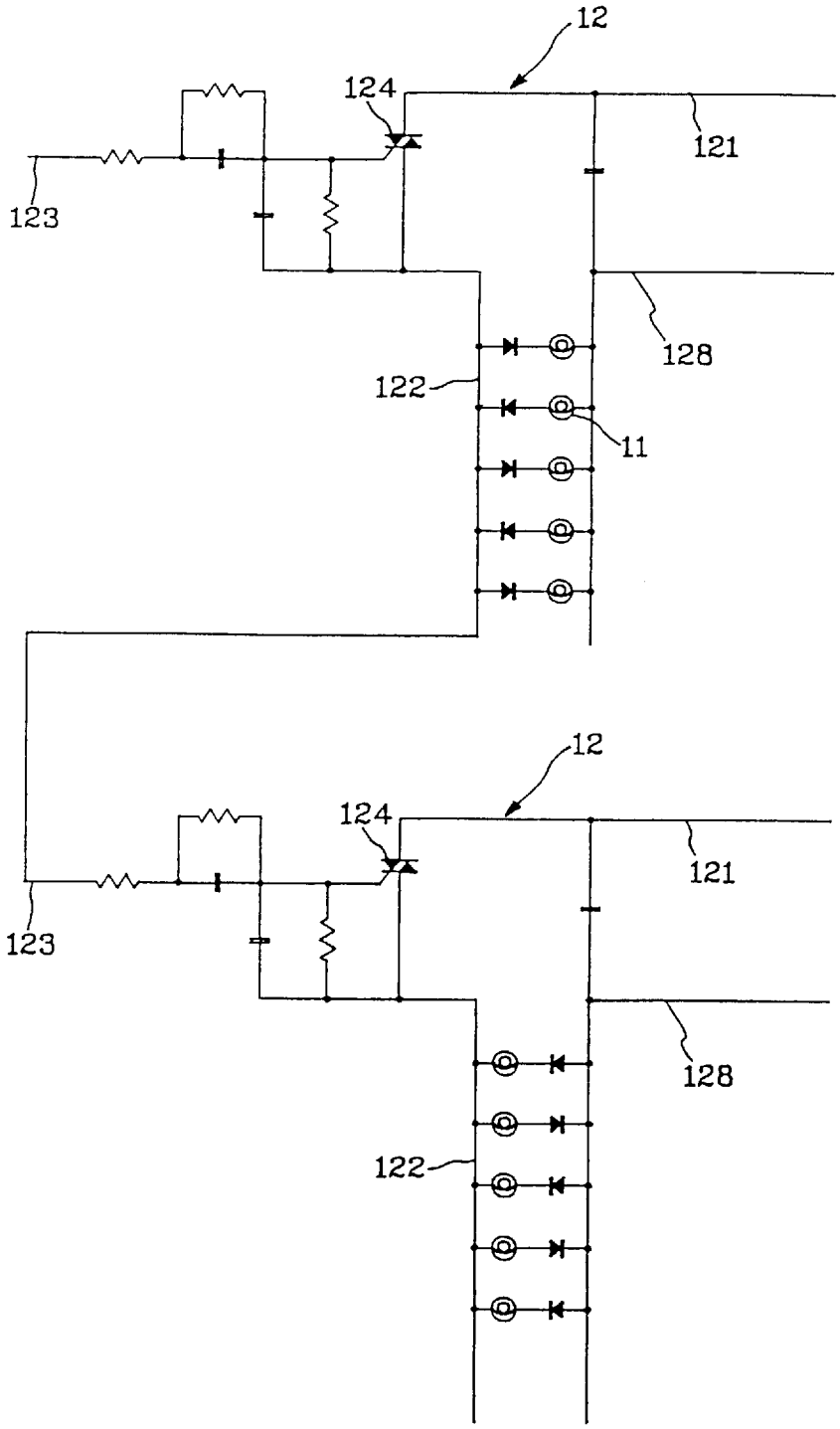
FIG. 4 is a circuit diagram showing the series-connection of more than one unit of the present invention.

Please refer to FIGS. 3 and 4 for the series-connection of multiple flicker light strings 1. To do so, first connect the trigger end 123 of a first flash light string 1 to a main driver 2 containing an oscillatory signal. Use the copper piercing means to pierce through an signal cord which extends from an output end 222 of the main driver 2 and contains the oscillatory signal. The signal cord is connected into the trigger circuit of the driver 12 so that the TRIAC transistor 124 thereof is electrically connected at the same time the oscillatory signal is received, causing the lamps 11 on the light string 1 to flicker synchronously. Since the oscillatory signal from the main driver 2 is led into the light string 1 simply to trigger the lamps 11 without increasing the load of the string 1, and since every subsequent light strings 1 either series connected to the first light string 1 or parallel connected to the main driver 2, all have their own independent external power supply, each of the light strings 1 has a load current that is used by the light string 1 itself instead of a total current used by all the series-connected light strings 1. Thus, no overload will occur in any of the individual light string 1 no matter how many units of the light string 1 are series or parallel connected.

Figure 5:
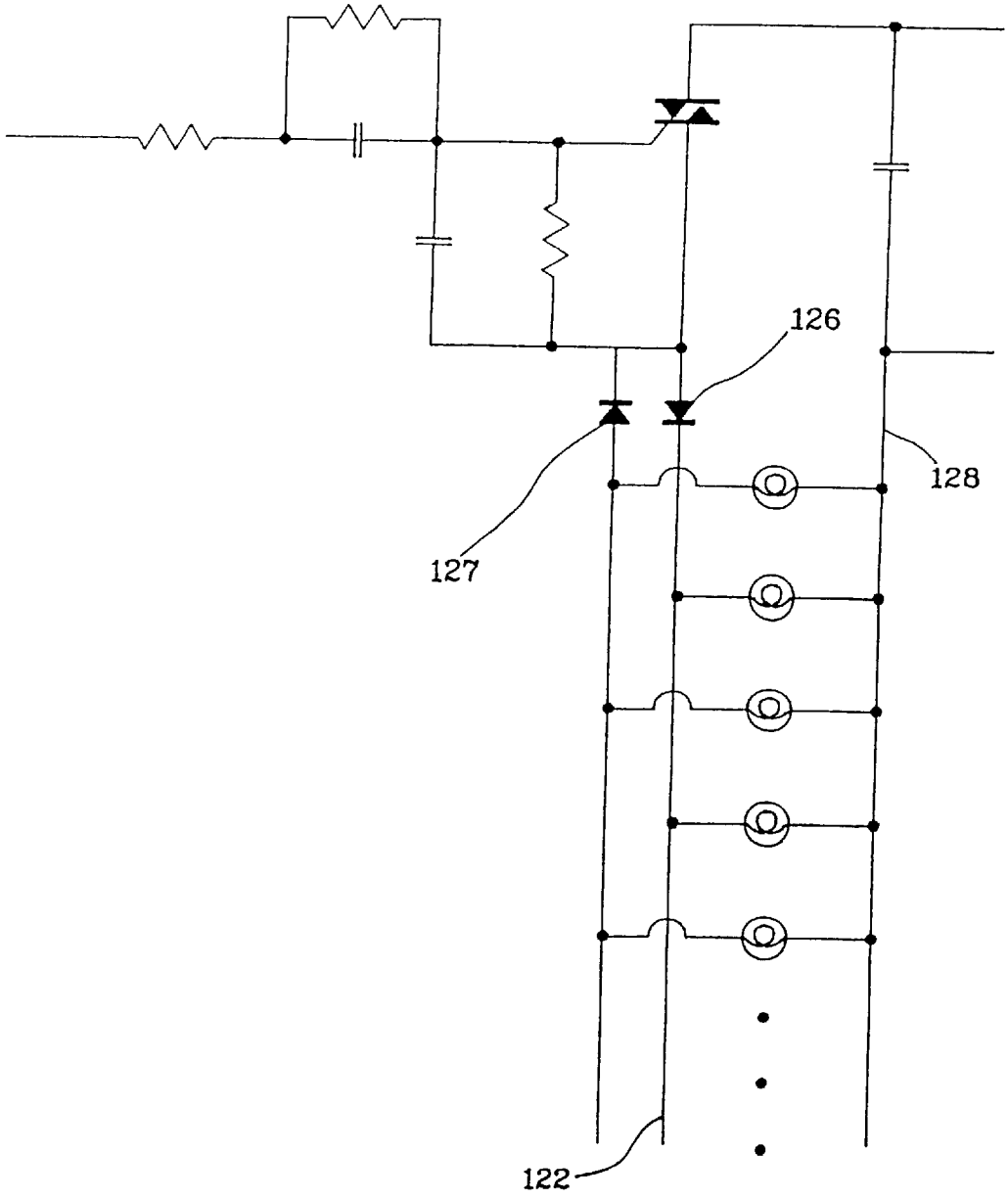
FIG. 5 is a circuit diagram of the present invention wherein the driver is changed from a two-wire to a three-wire output end.

Please refer to FIG. 5 now. In the event a three-wire output end is required in the present invention, it can be achieved by a series-parallel connection of two diodes 126 and 127 to a signal cord at the output end 122. With this simple change, the present invention can be more widely used either as a two-wire or as a three-wire light string 1 without the confusion of unmatched specification to prevent required wire connection.

From the above description, it can be seen that unlimited units of the flicker light string 1 of the present invention can be serially connected without any technical difficulty while all the connected flicker light strings can be lighted synchronously. In addition, following advantages are found in the present invention:

1. The light strings of the present invention are uniform in their specification and are therefore suitable for mass production. Since different units of the flicker light string can still flicker synchronously, it is not necessary to manufacture light strings in different or special specifications. The light strings in uniform specification may largely reduce the manufacturing cost and allow consumers to purchase and use them depending on their actual need.
2. The products of such light strings are safer in use and cheaper in price. The simplified specification of the light string also largely reduces the cost for electronic devices thereof and further ensures high safety of the light strings in use.
3. Unlimited numbers of light strings can be serially connected for them to flicker at the same time. Theoretically, since each light string has its own independent power supply, its operation is independent of the total power consumption of the whole connected light strings and of the gauge of wires. Thus, unlimited numbers of such light strings can be serially connected. It is surely a revolutionary invention in the industrial field.
4. It is very convenient to install the light strings. Every light strings other than the main light string can use the power of a lamp at any position after the driver of a preceding light string as its control signal. The light strings can be easily connected to form different patterns and the assembly and installation thereof is convenient.
5. The repair and maintenance of the light string is simple and convenient. A consumer needs only to replace a complete set of failed light string with a new one without the help of any professional electrician. The maintenance costs to be undertaken by the manufacturers and the consumers are both reduced.

In brief, the flicker light string according to the present invention has simple structure which not only allows mass production to reduce the manufacturing cost but also ensures safety in use and lower maintenance cost. That is, the flicker light string of the present invention provides new and special functions and significantly increases the economical benefit of the flicker light strings.

Although the present invention has been described with the preferred embodiments thereof, it should be noted that the present invention is not limited to such embodiments and various changes can be made without departing from the spirit of the present invention or the scope of the subjoined claims.

What is claimed is:

1. A synchronously flickering light array comprising:

a) a plurality of flicker light strings, each flicker light string comprising:
   i) a plurality of lights electrically connected together;
   ii) a driver having a trigger circuit electrically connected to the plurality of lights, the driver controlling the flickering of the lights on the light string; and,
   iii) a plug extending from the driver to connect the driver to an external power source; and, b) a trigger wire connecting a first flicker light string to a driver of a second flicker light string such that the lights on first and second flicker light strings flicker synchronously.

2. The synchronously flickering light array as claimed in claim 1, wherein said trigger circuit of said driver comprises a single triac transistor and other resistances and capacitances coupled therewith, and an output end of said trigger circuit comprises a two-wire output end.

3. The synchronously flickering light array as claimed in claim 1, wherein an output end of said trigger circuit of said driver has diodes parallel-connected to a signal cord extending therefrom to form a three-wire output end.

4. The synchronously flickering light array of claim 1 wherein at least three flicker light strings are used and further comprising at least one secondary trigger wire connecting the second flicker light string to the driver of at least a third flicker light string such that all lights flicker synchronously.

* * * * *